US010408018B2

(12) United States Patent
Schnell et al.

(10) Patent No.: US 10,408,018 B2
(45) Date of Patent: Sep. 10, 2019

(54) ACTUATION DART FOR WELLBORE OPERATIONS, WELLBORE TREATMENT APPARATUS AND METHOD

(71) Applicant: PACKERS PLUS ENERGY SERVICES INC., Calgary (CA)

(72) Inventors: Rodney Alan Schnell, De Winton (CA); Jeremy Charles Collie Hollan, Calgary (CA)

( * ) Notice: Subject to any disclaimer, the term of this patent is extended or adjusted under 35 U.S.C. 154(b) by 206 days.

(21) Appl. No.: 15/502,463

(22) PCT Filed: Aug. 7, 2015

(86) PCT No.: PCT/CA2015/050746
§ 371 (c)(1),
(2) Date: Feb. 7, 2017

(87) PCT Pub. No.: WO2016/019471
PCT Pub. Date: Feb. 11, 2016

(65) Prior Publication Data
US 2017/0218725 A1 Aug. 3, 2017

Related U.S. Application Data

(60) Provisional application No. 62/034,697, filed on Aug. 7, 2014.

(51) Int. Cl.

| | |
|---|---|
| ***E21B 34/14*** | (2006.01) |
| ***E21B 47/04*** | (2012.01) |
| ***E21B 33/12*** | (2006.01) |
| *E21B 34/00* | (2006.01) |

(52) U.S. Cl.
CPC ..... *E21B 34/14* (2013.01); *E21B 33/12* (2013.01); *E21B 47/04* (2013.01); *E21B 2034/007* (2013.01)

(58) Field of Classification Search
None
See application file for complete search history.

(56) References Cited

U.S. PATENT DOCUMENTS

| | | | | |
|---|---|---|---|---|
| 4,893,678 | A | 1/1990 | Stokley et al. | |
| 7,387,165 | B2 | 6/2008 | Lopez de Cardenas et al. | |
| 8,505,639 | B2 | 8/2013 | Robinson et al. | |
| 8,944,171 | B2 | 2/2015 | Parrott et al. | |
| 9,683,419 | B2 * | 6/2017 | Coon | E21B 23/08 |
| 2006/0124310 | A1 * | 6/2006 | Lopez de Cardenas | E21B 34/06 166/313 |
| 2007/0272411 | A1 | 11/2007 | Lopez de Cardenas et al. | |
| 2012/0085538 | A1 | 4/2012 | Guerrero et al. | |

(Continued)

FOREIGN PATENT DOCUMENTS

| | | |
|---|---|---|
| CA | 2842568 | 5/2014 |
| EP | 2728108 | 5/2014 |

(Continued)

*Primary Examiner* — Shane Bomar

(57) ABSTRACT

A wellbore assembly including an actuation dart for actuating a target tool in tubing string. The dart is activatable downhole, such that it can be moved past tools similar to the target tool without actuating them. The target tool may include a release mechanism that releases the actuation dart after being actuate by it. Such a target tool may be useful with a second tool that retains the actuation dart against further movement down the tubing string.

18 Claims, 5 Drawing Sheets

(56) References Cited

U.S. PATENT DOCUMENTS

| | | | | |
|---|---|---|---|---|
| 2013/0112436 | A1 | 5/2013 | Fleming et al. | |
| 2013/0206402 | A1 | 8/2013 | Coon | |
| 2013/0264056 | A1* | 10/2013 | Stout | E21B 43/261 166/281 |
| 2015/0060076 | A1 | 3/2015 | Campbell et al. | |
| 2016/0084075 | A1* | 3/2016 | Ingraham | E21B 23/10 166/255.1 |
| 2016/0251923 | A1* | 9/2016 | Keerthivasan | E21B 23/08 166/383 |
| 2018/0306001 | A1* | 10/2018 | Themig | E21B 34/10 |

FOREIGN PATENT DOCUMENTS

| | | |
|---|---|---|
| WO | 2011/134069 | 11/2011 |
| WO | 2012/037661 | 3/2012 |
| WO | 2012/045165 | 4/2012 |
| WO | 2014/186672 | 11/2014 |

* cited by examiner

ACTUATION DART FOR WELLBORE OPERATIONS, WELLBORE TREATMENT APPARATUS AND METHOD

FIELD

The invention relates to a method and apparatus for wellbore tool actuation and, in particular, to an actuation dart for selective actuation of a wellbore tool, wellbore treatment apparatus and methods relating thereto.

BACKGROUND

Recently wellbore treatment apparatus have been developed that include a wellbore treatment string for staged well treatment. The wellbore treatment string is useful to create a plurality of isolated zones within a well and includes an openable port system that allows selected access to each such isolated zone. The treatment string includes a tubular string carrying a plurality of external annular packers that can be set in the hole to create isolated zones therebetween in the annulus between the tubing string and the wellbore wall, be it cased or open hole. Openable ports, passing through the tubing string wall, are positioned between the packers and provide communication between the tubing string inner bore and the isolated zones. The ports are selectively openable and include a sleeve thereover with a sealable seat formed in the inner diameter of the sleeve. By launching a plug, such as a ball, a dart, etc., the plug can seal against the seat of a port's sleeve and pressure can be increased behind the plug to drive the sleeve through the tubing string to open the port and gain access to an isolated zone. The seat in each sleeve can be formed to accept a plug of a selected diameter but to allow plugs of smaller diameters to pass. As such, a port can be selectively opened by launching a particular sized plug, which is selected to seal against the seat of that port.

Unfortunately, however, such a wellbore treatment system may tend to be limited in the number of zones that may be accessed. In particular, limitations with respect to the inner diameter of wellbore tubulars, often due to the inner diameter of the well itself, restrict the number of different sized seats that can be installed in any one string. For example, if the well diameter dictates that the largest sleeve seat in a well can at most accept a 3¾" plug, then the well treatment string will generally be limited to approximately eleven sleeves and, therefore, treatment can only be effected in eleven stages.

SUMMARY

A wellbore actuation dart, wellbore assembly and method are taught in accordance with aspects of the invention.

In accordance with one aspect of the present invention, there is provided a wellbore assembly for selectively opening a port of a wellbore tubing string, the wellbore assembly comprising: a target tool in the wellbore tubing string, the target tool including a tubular body with an inner diameter, the port extending through a wall of the tubular body, a sleeve valve moveable to open the port; an actuation dart for actuating the target tool, the actuation dart comprising: a body conveyable through the wellbore tubing string to reach the target tool, an engagement mechanism on the body capable of engaging the sleeve on the target tool, a controller for activating the engagement mechanism in response to a signal from surface; and a dart removal mechanism on the target tool to drive the engagement mechanism out of engagement with the sleeve valve after the sleeve valve has moved to open the port.

In accordance with another aspect of the present invention, there is provided a method for actuating a target tool in a tubing string, the method comprising: conveying an actuation dart through the tubing string in an inactive condition; activating the actuation dart to an active condition at a position along the tubing string, the actuation dart in the active condition having a key for engaging in the target tool; moving the actuation dart to bring the key into engagement with the target tool; pressuring up behind the actuation dart to actuate a mechanism on the target tool while the actuation dart is engaged in the target tool; and driving the key out of engagement with the target tool by actuation of the mechanism.

In accordance with another aspect of the present invention, there is provided a method for staged injection of treatment fluids into selected intervals of a wellbore, the method comprising: running in a fluid treatment string having a first port sub and a second port sub axially spaced apart from the first port sub, the first port sub including a first port substantially closed against the passage of fluid therethrough by a first closure and the second port sub including a second port substantially closed against the passage of fluid therethrough by a second closure; conveying an actuation dart to pass through the tubing string; activating the actuation dart at a position in the well such that the actuation dart lands in the first port sub and actuates the first closure to open the first port, the actuation of the first closure releasing the actuation dart to continue through the tubing string; moving the actuation dart to pass through the tubing string until the actuation dart lands in the second port sub; and pressuring up on the actuation dart to actuate the second closure to open the second port.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF VARIOUS EMBODIMENTS

Figure 1A:
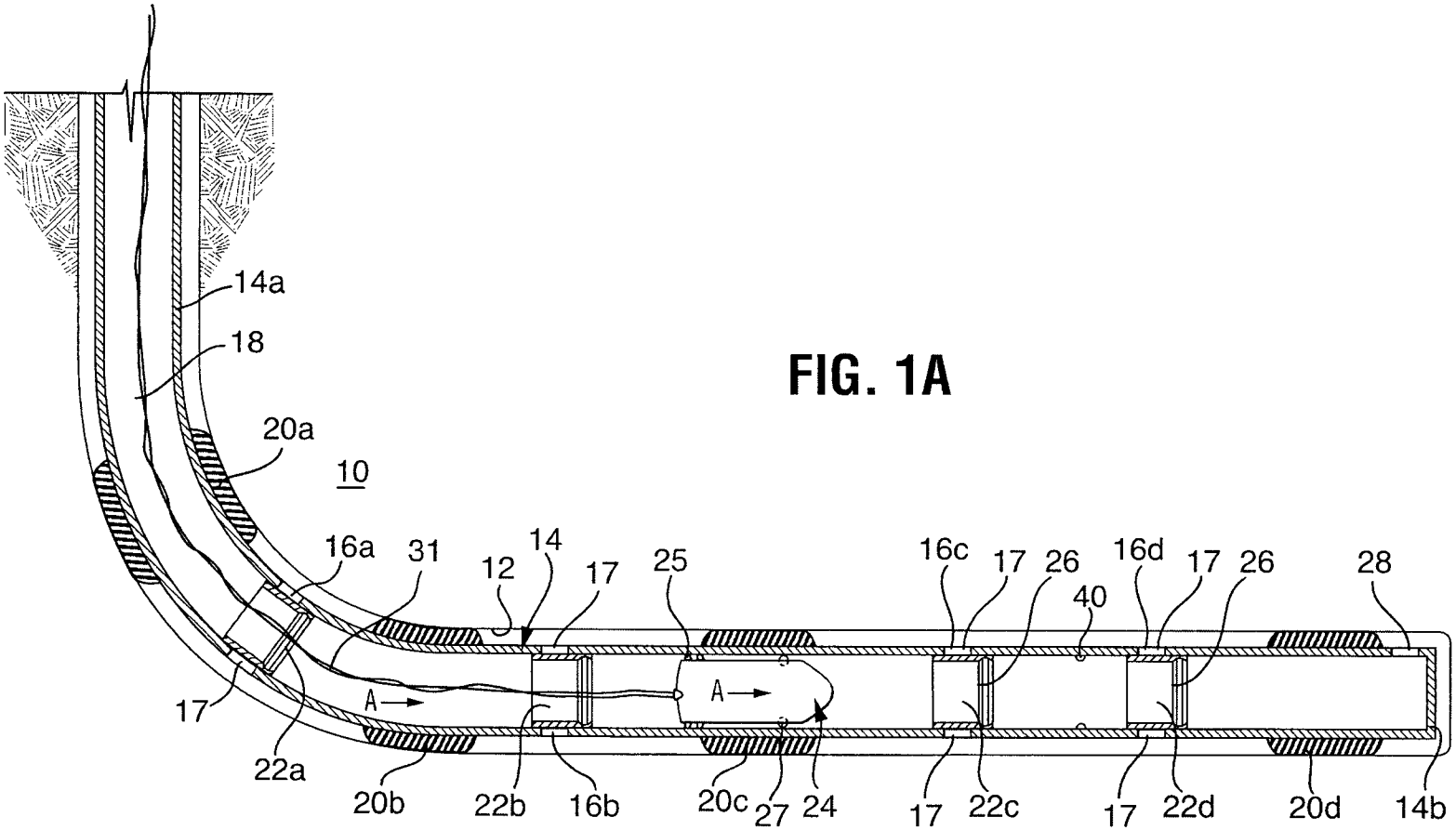
FIGS. 1A to 1D are a schematic sectional views through a wellbore with a wellbore assembly therein, the sequence of Figures show a sequence of method steps.
Figure 1B:
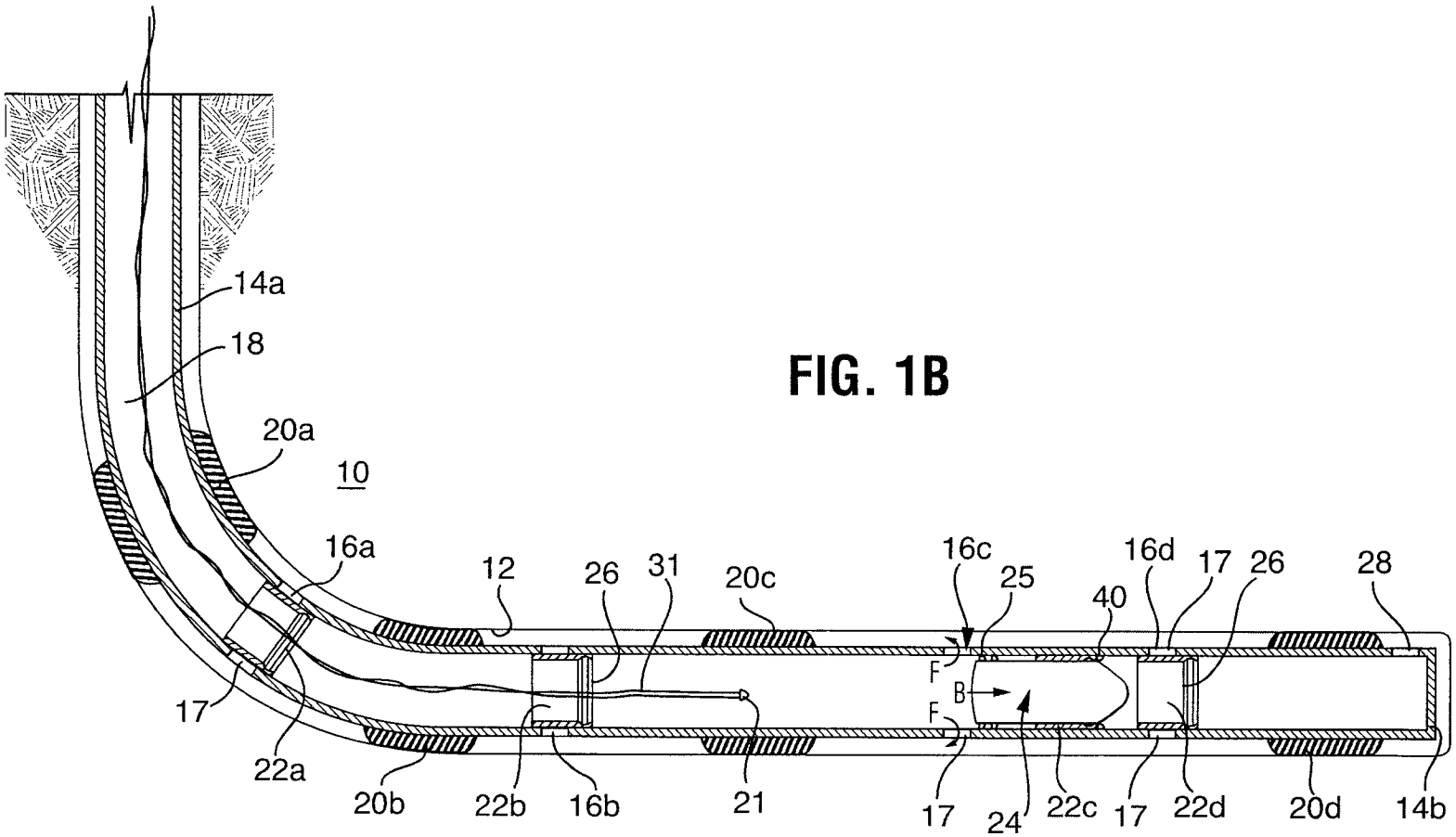
Figure 1C:
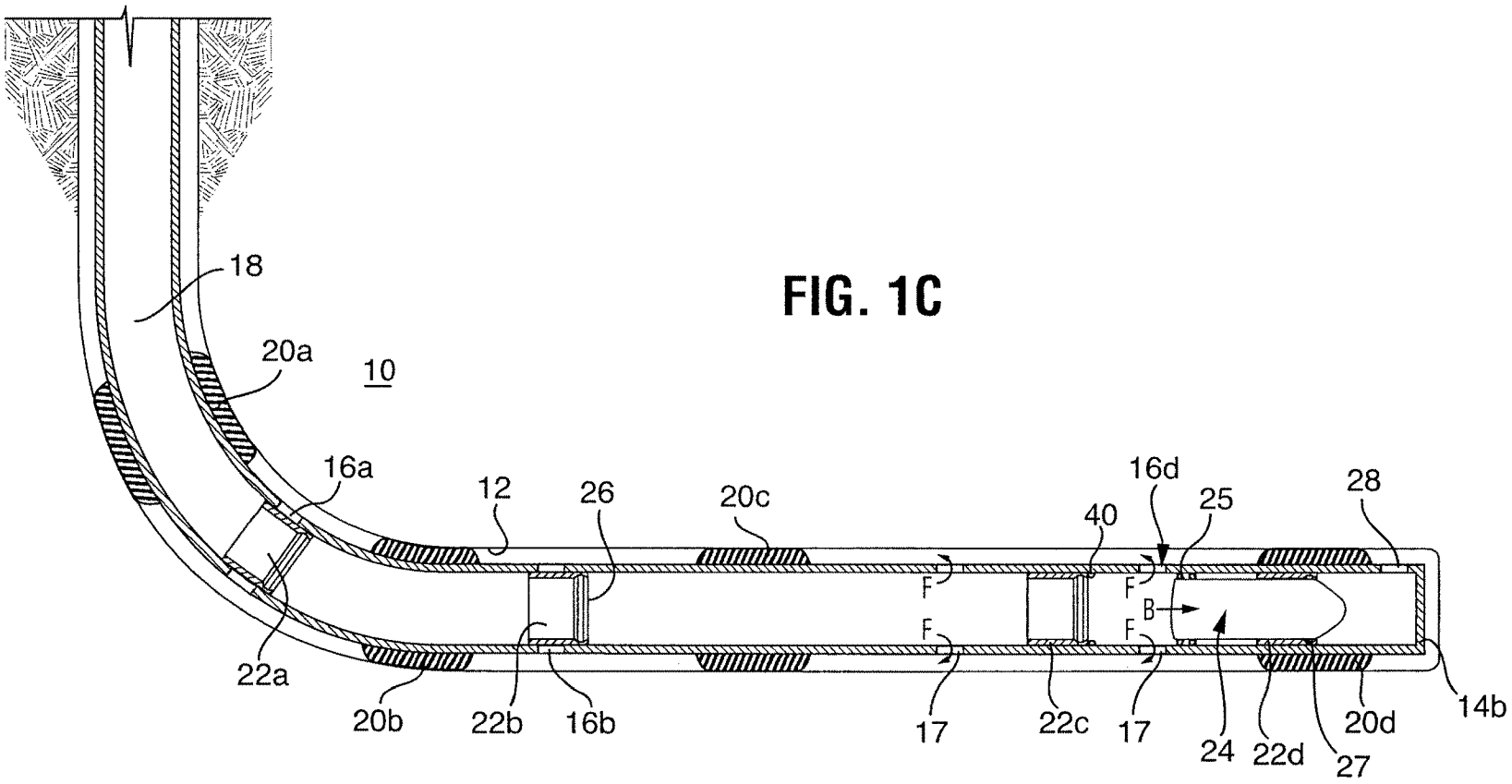

The description that follows and the embodiments described therein, are provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A wellbore actuation dart has been invented that is configurable to actuate a target tool in a tubing string. Apparatus and methods have been invented employing the actuation dart.

The actuation dart includes a body conveyable through a tubing string to reach a target tool and a key formed to engage the target tool, the key being retractable to be disengaged from the target tool such that the actuation dart can move through the tubing string to identify and actuate another target tool. According to an embodiment, the key engages the target tool by landing in an indent on the target tool. The indent may for example be an annular groove with a longitudinal length.

There may be a number of tools in the tubing string that all are intended to be actuated by the actuation dart. The actuation dart can land in and actuate each tool of the number of tools as the actuation dart passes through the tubing string.

There may, therefore, be a releasing mechanism in one or more of the number of tools that allow the actuation dart to be released from one target tool after the actuation dart has actuated that target tool so the actuation dart can move to a next target tool, and so on.

One of the number of tools, for example, the one closest to bottom hole, may not have the releasing mechanism as the actuation dart need not proceed further down the tubing string.

In one embodiment, the actuation dart has inactive and active conditions such that it can only actuate tools after being activated. Thus, the actuation dart, when in an inactive condition, can be run into a tubing string and will not actuate the tools that the inactive actuation dart passes, even though the tools may have a groove that, in fact, the actuation dart is capable of engaging in. After the actuation dart is configured to the active condition, however, any target tool that has a groove that allows the actuation dart to engage against the tool, will be actuated by the actuation dart, as it reaches the target tool.

Alternately or in addition, the action of the actuation dart to actuate the target tool may be mechanical, by engaging and moving a part of the target tool, such as a sleeve valve. Alternately or in addition, the action of releasing the actuation dart from the target tool may be mechanical, by driving the key out of engagement with the unique indent. The release mechanism for releasing the actuation dart from the target tool may be configured to respond or be activated (i.e. powered, exposed, etc.) only in response to the actuation of the target tool. In one embodiment, for example, the release mechanism is exposed and able to act upon the dart, after the tool is actuated. In another embodiment, the release mechanism is spaced from the target tool and is only accessed by the actuation dart once the tool is actuated.

The actuation dart may be employed in a method for actuating the target tool. The dart operates by passing through the tubing string and locating the target tool by engaging the dart's key in the indent of the target tool. After the target tool is located, the actuation dart can actuate the tool such as by driving a mechanism engaged by the tool and/or creating a seal in the tubing string adjacent the tool, for example, to block fluid flow therepast including for diversion of wellbore fluids. The target tool may, for example, be a packer, a port sub with a fluid treatment port, etc.

In one aspect of the invention the actuation dart is employed in a method and apparatus for staged injection of treatment fluids wherein fluid is injected into one or more selected intervals of the wellbore, while other intervals are closed. In another aspect, the method and apparatus provide for the running in of a fluid treatment string, the fluid treatment string having a plurality of port subs axially spaced apart therealong, each port sub including a port substantially closed against the passage of fluid therethrough, but which is openable by actuation of a closure, when desired, to permit fluid flow through the port into the wellbore; and conveying the actuation dart to pass through the tubing string and with its key riding along the tubing string inner wall, to locate a target port sub by having the dart's key land in the indent of the target tool and to actuate the port of the target port sub to open such that treatment fluid can be passed through the port to treat the interval accessed through the port.

The plurality of target port subs may include some that release the dart after actuation, so that the dart can continue down the tubing string to identify and actuate further of the plurality of target port subs.

The lower most target port sub of the plurality of target port subs may retain the actuation dart, as it is no longer needed to pass down through the tubing string and it may be retained to act as a plug against fluid passing down therepast, for example, to divert fluid to the actuated port subs.

The apparatus and methods of the present invention allow a wellbore treatment string to have a fully open ID, since protruding seats or stops are not required to stop the dart. The dart can be run and can reliably only actuate the tools of interest, without the difficulty of having the dart count or identify each tool.

The apparatus and methods of the present invention can be used in various borehole conditions including open holes, cased holes, vertical holes, horizontal holes, straight holes or deviated holes.

With reference to FIGS. 1A to 1D, a wellbore fluid treatment assembly is shown, which can be used to effect fluid treatment of a formation 10 through a wellbore 12. The wellbore assembly includes a tubing string 14 having an upper end 14*a* extending toward surface (not shown) and a lower end 14*b*. Tubing string 14 includes a plurality of spaced apart port subs 16*a* to 16*d* each including a plurality of ports 17 opened through the tubing string wall to permit access between the tubing string inner bore 18 and the wellbore.

A packer 20*a* is mounted between the upper-most port sub 16*a* and the surface and further packers 20*b* and 20*c* are mounted between each pair of adjacent port subs. In the illustrated embodiment, a packer 20*d* is also mounted below the lower-most port sub 16*d* and lower end 14*b* of the tubing string. The packers are each disposed about the tubing string, encircling it and selected to seal the annulus between the tubing string and the wellbore wall, when the assembly is disposed in the wellbore and the packers are set (as shown). The packers divide the wellbore into isolated zones wherein fluid can be applied to one zone of the well, but is prevented from passing through the annulus into adjacent zones. As will be appreciated, the packers can be spaced in any way relative to the port subs to achieve a desired zone length or number of port subs per isolated zone. In addition, packer 20*d* need not be present in some applications.

The packers may be of various types. In this illustration, packers 20 are of the solid body-type with at least one extrudable packing element, for example, formed of rubber. Solid body packers including multiple, spaced apart packing elements on a single packer are particularly useful, for example, in open hole (unlined wellbore) operations. In another embodiment, a plurality of packers is positioned in side-by-side relation on the tubing string, rather than using one packer between each port sub.

While packers are shown, it is to be understood that the string 14 could be installed in the wellbore with annular cement rather than or in addition to packers 20. For example, cement could be employed to fill the annulus between string 14 and the wall of wellbore 12 to provide annular isolation. The cement can prevent fluid passing through the annulus and can divide the wellbore into isolated zones wherein fluid can be applied to one zone of the well is prevented from passing through the annulus into adjacent zones.

Closures in the form of sliding sleeves 22*a* to 22*d* are disposed to control the opening of the ports 17. In this embodiment, a sliding sleeve is mounted in each ported sub 16*a* to 16*d* to close the ports in that sub against fluid flow therethrough. However, each sleeve can be moved away, arrow B, from its position covering its port to open that port and allow fluid flow therethrough. In particular, each sliding sleeve may be disposed to control the opening of its port sub and each sliding sleeve may be moveable from a closed port position covering its associated ports (as shown by all sleeves in FIG. 1A) to an open port position away from its ports wherein fluid flow of, for example, stimulation fluid, arrows F, is permitted through its ports (as shown by sleeves 22*c* and 22*d* in FIG. 1C). While sleeves are shown, the closures may take other forms or include other structures such as kobe subs.

The tubing string is run in and positioned downhole with the sliding sleeves each in their closed port position. The sleeves are moved to their open position when the tubing string is ready for use to fluid treat the wellbore. One or more isolated zones can be treated depending on the sleeves that are opened. For example, in a staged, concentrated treatment process, the sleeves for each isolated zone between adjacent packers may be opened individually to permit fluid flow to one wellbore zone at a time or a plurality of sleeves can be opened to treat the one or more zones accessed therethrough, with a next stage of treatment opening a next plurality of sleeves to access a next one or more zones.

The sliding sleeves are each actuated by an actuation dart, such as a dart 24, which can be conveyed by gravity or fluid flow through the tubing string. In the illustrated embodiment, dart 24 includes an annular seal 25 about its body. Annular seal 25 is selected to create a substantial seal with the inner wall of the tubing string such that the dart can be employed to establish a pressure differential thereacross. For example, dart 24 may be pumped by fluid pressure through the string's inner bore 18 and if held in place in the well, can substantially stop passage of fluid therepast.

To actuate a sleeve, the actuation dart engages against the sleeve. In this case, dart 24 engages against sleeve 22*c*, and, when pressure is applied through the tubing string inner bore 18 from surface, dart 24 creates a pressure differential above and below the sleeve which drives the sleeve toward the lower pressure side, which is downhole of the sleeve and the dart.

While many engagement members may be employed such as dogs, shoulders, catches, collets, etc., in the illustrated embodiment, the inner surface of each sleeve which is open to the inner bore of the tubing string defines a groove 26 into which a key 27 on an associated dart 24, when launched from surface, can engage. When the dart's key engages in the sleeve's groove and pressure is applied or increased from surface, a pressure differential is set up, in this case by seal 25 on the dart that seals against the tubing string inner wall. The inner wall may be polished at selected areas where the dart's seal 25 is to land, in order to ensure a good fluid seal is formed. The pressure differential generated causes the sliding sleeve against which the dart has engaged to slide to a port-open position. When the ports of the port sub 16*c* are opened, fluid can flow through ports 17 to the annulus between the tubing string and the wellbore in the isolated zone between packers and, thereafter, into contact with formation 10. Key 27 on dart 24, therefore, acts as an actuation mechanism in cooperation with seal 25 and groove 26, to actuate the sleeve to move to its port-open position. Other actuation mechanisms can be employed, as will be appreciated based on the example embodiments described hereinbelow.

After actuation of sleeve 22*c*, dart 24 is required to continue along the tubing string to actuate sleeve 22*d*. As such, dart 24 must be removed from sleeve 22*c*. There is a release mechanism 40 for sleeve 22*c* that forces the release of the dart after the actuation of the sleeve. In fact, actuation of sleeve 22*c* may release the dart by, for example, exposing a release mechanism to act against the dart or driving the dart against a release mechanism.

Once released, the dart can then move to actuate a next sleeve 22*d*. To do so, the actuation dart engages against that next sleeve 22*d*. In this case, dart 24 engages groove 26 of sleeve 22*d*, and, when pressure is applied through the tubing string inner bore 18 from surface, dart 24 creates a pressure differential above and below the sleeve 22*d* which drives that sleeve toward the lower pressure side: downhole of the sleeve and the dart.

Sleeve 22*d* is the lower most sleeve in the group of sleeves to be actuated by dart 24. Sleeve 22*d* retains the dart even after the sleeve is actuated. In particular, sleeve 22*d* has no release mechanism. Since the dart remains secured in sleeve 22*d*, it blocks the passage of fluid through the tubing string. As such, dart 24 diverts fluid to the ports 17 that have been opened at sleeves 22*c*, 22*d*.

Dart 24 can remain in the well. More likely, however, it is desirable to remove the dart so the well is able to back flow and produce. In one embodiment, the dart includes a function to return to an inactive condition such that the key 27 can retract and the dart can be moved away from sleeve 22*d*, or a bypass channel is opened or the dart can be formed of a material that breaks down, such as dissolves, with residence time in the well.

Dart 24 targets sleeves 22*c*, 22*d* and actuates those sleeves 22*c*, 22*d*, while the dart does not actuate other sleeves 22*a*, 22*b*. In particular, as shown, dart 24 is configured to pass by other sleeves 22*a*, 22*b* but locates and actuates sleeves 22*c*, 22*d* when it contacts those sleeves. To do so, dart 24 is only activated when it is positioned below sleeve 22*b* and above the sleeves 22*c*, 22*d* to be actuated. Dart 24 can be run in an inactive condition and only activated when it is to be used to actuate the sleeves. For example, the dart may be run with its key 27 retracted so that the dart doesn't risk engagement in any sleeves, such as sleeves 22*a*, 22*b* while running past them into the hole and dart 24 is only activated to have keys 27 capable of engaging in sleeves 22*c*, 22*d*, when dart 24 is appropriately positioned: downhole of any sleeves not to be actuated and at or just uphole of the group of sleeves to be actuated.

In this embodiment, dart 24 is run in on wireline 31 and is connected to wireline through a wireline connector 21 that provides for releasable connection between the dart and the wireline. Wireline 31 allows for depth determination for the dart, by recording the length of wireline run with the dart, and activation of the dart, by signaling through the wireline. Wireline 31 allows for positive depth confirmation and signaling. While this could also be done with coil tubing, the use of wireline instead of coil tubing offers an operational ease and cost advantage.

To permit key 27 to actuate a plurality of sleeves, the key is able to be released from at least some sleeves, while the key is retained by other sleeves. As shown, for example, to actuate both sleeves 22*c* and 22*d*, dart 24 must actuate sleeve 22*c* and then move along the tubing string inner diameter to engage and actuate sleeve 22*d*. To do this, sub 16*c* is equipped with a release mechanism 40 to disengage the dart from sleeve 22*c*, while the sub 16*d* that is to retain the dart has no such release mechanism.

Thus, a tubing string may include two types of port subs in each group of port subs to be actuated by a dart: one or more, termed herein a type A sub 16*c*, that releases the dart after the port sub is actuated to open its ports 17; and a lowermost port sub, termed herein a type B sub 16*d*, that retains the dart after the port sub is actuated to open its ports.

Thus, with the two types of port subs, one method can include connecting the dart to a line such as wire line and running the dart in on the wireline. After the wireline-deployed dart is pumped to the first (A-type) port sub that it is to actuate (which may be below downhole of other A-type ports not to be actuated), an electric signal may be sent from surface through the line to activate the dart such that it is capable of engaging the sleeve of the A-type port sub. With the dart engaging the sleeve, pumping to increase tubing pressure will open the port. After the port is opened, the A-type port sub will then "release" the dart to allow the dart to be pumped down to a next A-type port sub or a B-type (non-releasing) port sub. The B-type port sub will be the last in the group of subs to be actuated, because the B-type port sub will not allow the dart to pass, even after it has functioned to open the ports 17, and perhaps even after a frac operation is completed through the ports opened by the dart.

If desired, the dart can have a powered function allowing it to become inactivated after it has acted to open the sleeve. In such an embodiment, after a pre-set amount of time, the dart can be inactivated, for example, the keys of the dart can collapse to the run-in position so that the dart can be pumped (pushed) to the toe of the well or can be flowed back to surface. In such an embodiment, if the batteries ever die, the dart may have a control option to "fail", for example, the keys/fingers can retract automatically. This may avoid having the dart permanently locked into the B-type port sub and thereby avoid having a permanent plug in the string.

If it is desired to open one or more other port subs in the tubing string, another dart can be conveyed. For example, as shown in FIG. 1D, another dart 24' can be launched from surface and activated to actuate sleeve 22*a*, as the type A sub and sleeve 22*b* as the type B sub. Dart 24' can be run in an active or an inactive condition as it is intended to actuate the group of uppermost sleeves. However, to facilitate targeted operation, it may be run inactive and only activated when it is close above or at the first sub to be actuated.

In this embodiment, dart 24' is similar structurally to dart 24. For example, dart 24' has a body with a similar diameter to that of dart 24 and a wireline connector 21', a seal 25' and a protrusion 27', all of which are similar to those on dart 24.

Dart 24' actuates sleeve 22*a* as the dart passes by sleeve 22*a* to reach sleeve 22*b*. The actuation of sleeve 22*a*, opens it and, when opened, dart 24' is released from sleeve 22*a* and moves to sleeve 22*b*.

When dart 24' is at or just uphole of sleeve 22*a*, it can be activated to actuate the sleeves. For example, the dart may be run with its key 27 retracted or able to retract so that the dart doesn't risk engagement in any structure, while running into the hole.

Since a dart may block the tubing string inner bore, the darts may be launched in an order corresponding to the positions of their target sleeves in the tubing string. For example, the dart targeted to the lowest group of sleeves (i.e. the one closest to end 14*b*) may be launched first, followed by the dart for the sleeve or group of sleeves next closest to surface and followed by the dart for the sleeve or group of sleeves next closest to surface. For example, in the illustrated tubing string, dart 24 is configured to target lower sleeves 22*c* and 22*d* and is launched first. Dart 24' is configured to target sleeves 22*a*, 22*b* uphole from sleeves 22*c*, 22*d* and dart 24' is launched next.

Darts 24, 24' create a seal in the tubing string. While this may be useful for wellbore treatment, their continued presence downhole may adversely affect backflow of fluids, such as production fluids, through tubing string 14. Thus, darts 24, 24' may be selected to be releasable from their sleeves after their use to actuate their sleeves and divert fluid is concluded. Thereafter, the darts may be moveable with backflow back toward surface or may be pushed down hole toward end 14*b*. Alternately, the darts 24, 24' may include a valve openable in response to backflow, such as a one way valve or a bypass port openable in a period of time after their use as a flow diverter. In another embodiment, at least the bodies of the darts are formed of a material dissolvable at downhole conditions. For example, the bodies may be formed of a material dissolvable in hydrocarbons such that they dissolve when exposed to back flow of production fluids.

Lower end 14*b* of the tubing string can be open, closed or fitted in various ways, depending on the operational characteristics of the tubing string, which are desired. In the illustrated embodiment, lower end 14*b* includes a hydraulically openable port such as a pump out plug 28. Pump out plug 28 acts to close off end 14*b* during run in of the tubing string, to maintain the inner bore of the tubing string relatively clear. However, by application of fluid pressure, for example at a pressure of about 3000 psi, the plug can be opened, for example blown out, to allow fluid conductivity through string 14. As will be appreciated, an opening adjacent end 14*b* is only needed where pressure, as opposed to gravity, is needed to convey the first dart to land in the lower-most group of sleeves. In other embodiments, not shown, end 14*b* can be left open or can be closed, for example, by installation of a welded or threaded plug.

While the illustrated tubing string includes four port subs, it is to be understood that any number of port subs could be used. In a fluid treatment assembly desired to be used for staged fluid treatment, at least two port subs are provided with openable ports from the tubing string inner bore to the wellbore are provided. It is also to be understood that any number of ports can be used in each interval. It is also to be understood that there can be other tubing string components. There can be other sleeves in the string such as a sleeve below sleeve 22*d*, which is hydraulically actuated, including a fluid actuated piston secured by shear pins, so that the sleeve can be opened remotely without the need to land a dart therein. Alternately or in addition, there may be plug actuated sleeves having graduated sized seats. Centralizers, liner hangers and other standard tubing string attachments can be used, as desired.

In use, the wellbore fluid treatment apparatus, as described with respect to FIGS. 1A to 1D, can be used in the fluid treatment of a wellbore, for example, for staged injection of treatment fluids, wherein fluid is injected into one or more selected intervals of the wellbore, while other intervals are closed.

In one aspect, the method includes running in of fluid treatment string 14 with its ports 17 substantially closed against the passage of fluid therethrough by sliding sleeves 22*a*-22*d*.

Before running in, tubing string 14 is constructed using a plurality of sleeve subs 16*a*-16*d* including sleeves 22*a*-22*d* installed in the tubing string inner diameter. The sleeves are installed such that where there are a group of the sleeves to be actuated by one dart, that group includes release mechanisms 40 for all of the upper sleeves in the group and no release mechanism for the lowermost sleeve in the group.

The sleeve groupings are recorded along with the location for each group of ported subs in the tubing string. The sleeve and groove diameters may be substantially similar for all sleeves.

Figure 1D:
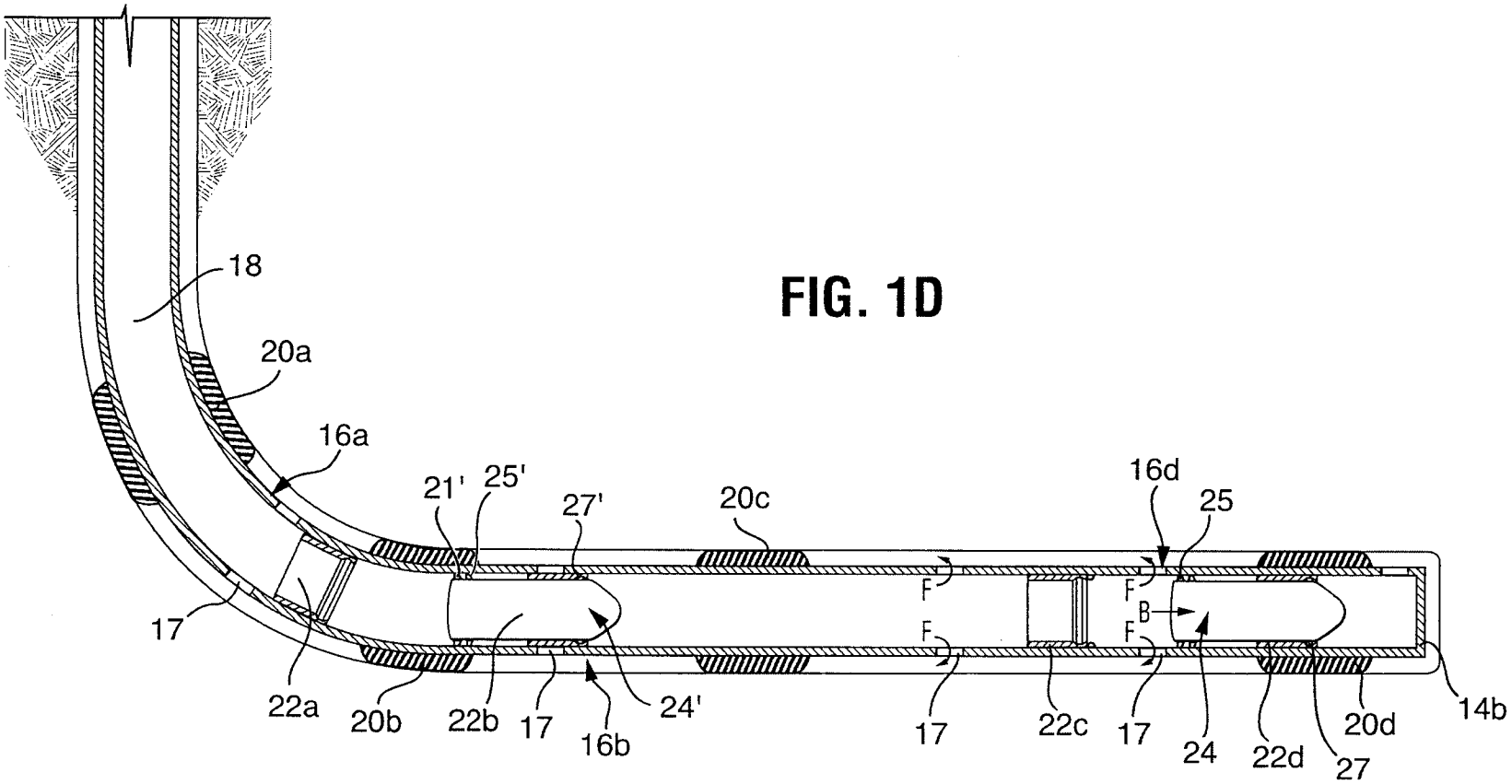

Thereafter, as shown in FIG. 1A, an actuation dart, here shown as dart 24, is passed in an inactive condition through tubing string inner diameter 12 until dart 24 is below those sleeves not be actuated and is at or just above a target sleeve 22*c*. Dart 24 is then activated and moved to actuate that port sub 16*c* to open its port (FIG. 1B) such that treatment fluid, arrows F, can be passed through the port to treat the zone accessed through the port. In this embodiment, sub 16*c* has a sleeve valve 22*c* covering its ports 17 and actuating port sub 16*c* to open its ports including moving, arrow B, sleeve valve 22*c* down by hydraulic pressure to expose ports 17.

The dart is then released from sleeve 22*c* and moves to actuate the next target port sub 16*d* to open its port (FIG. 1C) such that treatment fluid, arrows F, can be passed through the port to treat the zone accessed through the port. In this embodiment, sub 16*d* has a sleeve valve 22*d* covering its ports 17 and actuating port sub 16*d* to open its ports including moving, arrow B, sleeve valve 22*d* down by hydraulic pressure to expose ports 17. Dart 24 remains in sleeve 22*d* to ensure that fluid is diverted to the ports in subs 16*c*, 16*d* opened by the dart.

Each dart, such as dart 24, operates by being activated only when the dart has proceeded downhole of sleeves it is not to actuate and is positioned adjacent and just above the subs to be actuated. Thus, dart location should be monitored.

Thus, in this embodiment, dart 24 operates by passing, arrows A, through the tubing string inner bore 18 (FIG. 1A) on a wireline 31, being activated by a signal through the wireline when the dart is appropriately positioned and then moved through the one or more target sleeves at or below the dart. The wireline depth can be logged through a depth counter. The wireline may be employed to monitor the depth of the dart by a depth counter or collar locator. The dart may move by pumping against seal 25, with the wireline trailing behind.

The dart will be located on depth, then activated and then pumped into engagement with the first sleeve to be actuated. A pressure indication will indicate that the sleeve has shifted. If desired, the dart may remain attached to the wireline at least till this point, to confirm proper function before detachment from the wireline.

If possible, the sleeves or collar connections passed by the dart may also be counted. However, to avoid concerns with wear of the key, the key may be selected to avoid catching in the sleeves/collar connections on the way in hole. For example, the key may be retracted during run in to avoid riding along the string inner wall and catching in the sleeves passed during run in. The key may also be longer than other gaps, such as in casing collars, in the string.

The wireline may be disconnected after the dart is signaled to become active or the wireline may remain attached, continuing to be pulled along. If detached, the wireline may be pulled to surface or left in place.

If there is more than one target sleeve in the group of target sleeves, the dart is released by the upper sleeves after actuation of them so that it can move through the group. The lowermost sleeve in the group, after actuation by the dart may retain the dart. After locating its target sleeve, FIG. 1B, actuation dart 24 can actuate the sleeve to open as by engaging the sleeve and driving it away from ports 17 that the sleeve overlies. In the illustrated embodiment, dart 24 opens sleeve 22*c* by engaging the sleeve and creating a seal in inner bore 18 above and below it, through which can be generated a pressure differential to shift the sleeve down in the string, arrows B.

After opening sleeve 22*d*, dart 24 remains engage therein to divert fluid through the now exposed ports 17.

For selectively treating formation 10 through wellbore 12, the above-described tubing string 14 is run into the borehole and packers 20 are set to seal the annulus at each location creating a plurality of isolated annulus zones. In this embodiment, dart 24 is connected via wireline to surface and is moved by fluid pressure and thus, fluid conductivity through string 14 is required to achieve conveyance of the dart. To obtain fluid conductivity, fluids can then be pumped down the tubing string to pump out plug assembly 28. Alternately, a plurality of open ports or an open end can be provided or lower most sleeves can be hydraulically openable. Once that injectivity is achieved, dart 24 is launched from surface and conveyed by fluid pressure.

By selective activation of dart 24, it passes though all of the sleeves, including sleeves 22*a*, 22*b* closer to surface, without actuating them, but engages in its target sleeves 22*c* and 22*d* to actuate them. For example, dart 24 engages against sleeve 22*c*, seal 25 seals off fluid access to the tubing string below sleeve 22*c* and generates a pressure differential that drives the dart, which in turn drives sleeve 22*c* to open port sub 16*c*. The dart is then released from sleeve 22*c* and the dart moves to actuate sleeve 22*d*. This may allow the isolated zone or zones accessed through the ports of subs 16*c*, 16*d* (i.e. the zone between packer 20*c* and packer 20*d*) to be treated with fluid and/or the opened ports can permit flow of production fluids therethrough. If injecting fluids, the treating fluids will be diverted through the ports of subs 16*c*, 16*d* that are exposed by moving the sliding sleeves and will be directed to a specific area of the formation.

When fluid treatment through port subs 16*c*, 16*d* is complete, another dart 24' may be launched to actuate its target sleeves 22*a*, 22*b* (FIG. 1D).

This process of launching darts for the sleeves progressively closer to surface is repeated until all of the zones of interest are treated. After treatment, fluids can be shut in or flowed back immediately. Once fluid pressure is reduced from surface, any darts engaged in sleeves 22 can be removed, if desired, to permit fluid flow upwardly through inner diameter 18. For example, darts 24, 24' can be inactivated and unseated by pressure from below and pushed back toward surface, the darts can have bypass channels opened therethrough, the darts can dissolve or the darts can be drilled out.

To ensure that the darts can keep moving through the string after opening some ports in the group of target tools, the ports, especially those of type A subs 16*a*, 16*c*, may be configured to avoid immediate pressure release when their sleeves are include opened. For example, the ports may be limited entry, include burst or dissolvable plugs, etc.

The apparatus is particularly useful for stimulation of a formation, using stimulation fluids, such as for example, acid, water, oil, $CO_2$ and/or nitrogen, with or without proppants.

Figure 2:
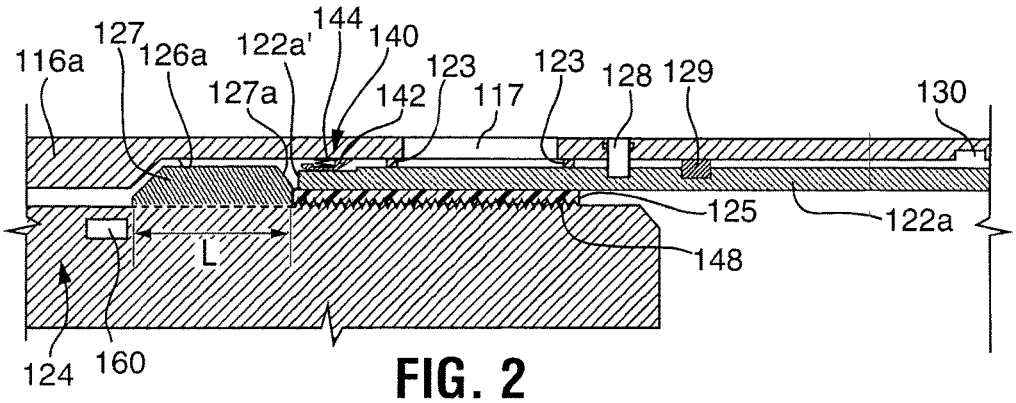
FIG. 2 is a sectional, schematic view along the long axis of a wellbore tool being actuated by a dart. The wellbore tool includes a seat that will release the dart after actuation of the tool.
Figure 3:
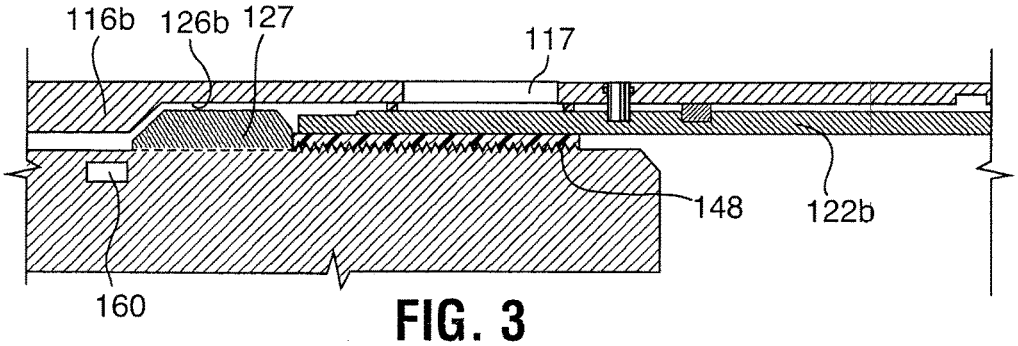
FIG. 3 is a sectional, schematic view along the long axis of a wellbore tool being actuated by the dart of FIG. 2, the wellbore tool being of the type that will not release the dart after actuation of the tool.

Referring to the FIGS. 2 and 3, there is shown a wellbore assembly including port subs 116*a*, 116*b* for operation with a dart 124.

FIG. 2 shows one port sub 116*a*, a type A sub, useful to be actuated by dart 124 and then from which the dart can be released. The port sub includes a release mechanism 140 that drives the dart out of engagement with the port sub, once it has been actuated by the dart. In particular, in this embodiment, the port sub has a port 117 that is closed by a sleeve valve 122*a*. Seals 123 are present between sleeve valve 122*a* and the wall of the port sub to seal against the leakage of fluid through port 117 when the sleeve valve is positioned over the port. The port sub is actuated to be opened by the dart by a key 127 of the dart engaging in a groove 126*a* adjacent the sleeve valve. The dart key 127, when engaged in the groove 126*a*, has a shoulder 127*a* positioned against a shoulder 122*a*' of sleeve 122*a* and seal 125 sealed against an inner diameter of sleeve 122*a*. When a pressure differential is established across seal 125, dart 124 bears against the sleeve, overcomes shear pins 128 and drives the sleeve to move to expose ports 117 and open the port sub. In particular, when a pressure differential is established across seal 125 caused by the plugging effect of the dart within the sleeve, the shoulder 127*a* of key 127 bears against shoulder 122*a*' of the sleeve, and the dart moves the sleeve to open the port 117. The sleeve may be held open by a lock 129, such as a C-ring, engageable in a gland 130.

Release mechanism 140 is only exposed when sleeve 122*a* is moved. When sleeve 122*a* is moved to open ports 117, the release mechanism is exposed to act on the key. Release mechanism 140 drives key 127 out of engagement with the groove 126*a* so that dart 124 is freed to move down the tubing string. For example, release mechanism 140 can be covered by sleeve valve 122*a* and only exposed when the sleeve valve is moved to open its ports 117. In the illustrated embodiment, mechanism 140 includes a plurality of fingers 142 biased outwardly, as by a spring 144, when freed by movement of sleeve 122*a* to push against key 127 when the key rides over the fingers. Key 127 is retractable into the main body of dart 124 and, when the key is retracted, the dart can move out of engagement with groove 126*a*.

FIG. 3 shows another port sub 116*b*, a type B sub, which is actuated by the same dart 124 but retains the dart thereafter. Port sub 116*b* is very similar to port sub 116*a*, except it doesn't have a release mechanism. For example, see the empty space at N where the release mechanism was in the type A sub (FIG. 2). Dart 124 therefore remains retained in groove 126*b* even after its sleeve 122*b* is moved to open its ports 117, as the tool is devoid of a release mechanism and, so, there is nothing to disengage the dart keys 127 from the groove.

Figure 4:
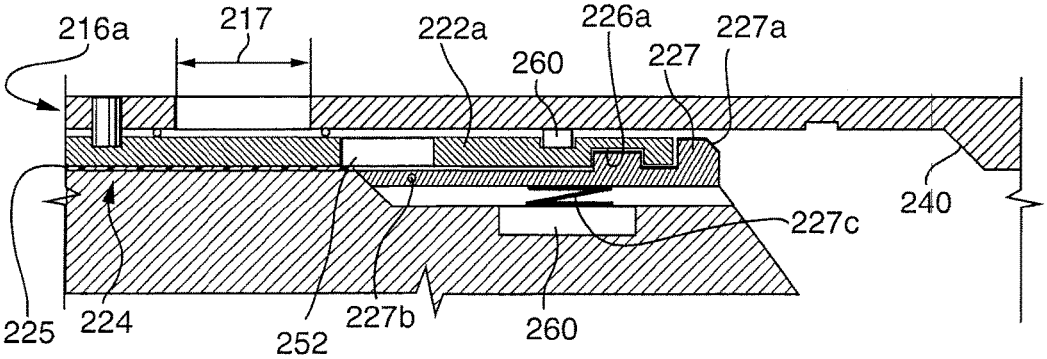
FIG. 4 is a sectional, schematic view along the long axis of a wellbore tool being actuated by a dart. The wellbore tool includes a seat that will release the dart after actuation of the tool.
Figure 5:
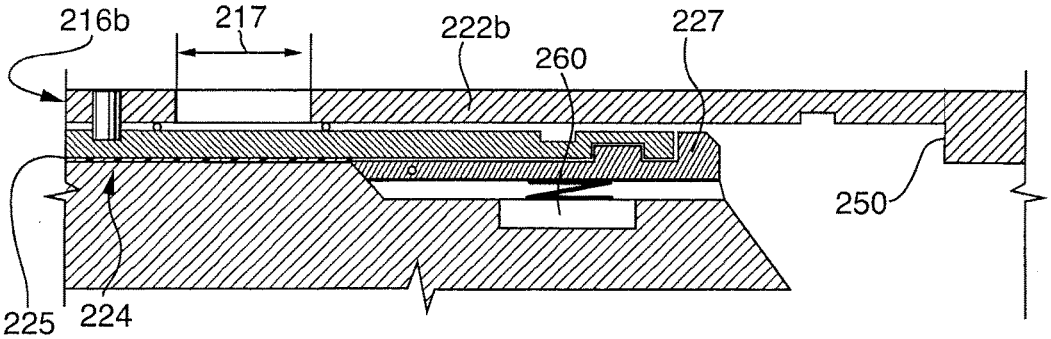
FIG. 5 is a sectional, schematic view along the long axis of a wellbore tool being actuated by the dart of FIG. 4, the wellbore tool being of the type that will not release the dart after actuation of the tool.

FIGS. 4 and 5 show another wellbore assembly embodiment with two port subs 216*a*, 216*b* and a dart 224. The dart actuates and thereafter becomes released from the type A port sub 216*a* of FIG. 4 and actuates and is retained in the type B port sub 216*b* of FIG. 5. Port sub 216*a* includes a release mechanism, while port sub 216*b* does not include a release mechanism. In this embodiment, the release mechanism is a ramped surface 240 on the sub's housing adjacent to sleeve 222*a*.

Sleeve 222*a* is moveable within the sub housing and movement of the sleeve from the closed port position to the open port position moves sleeve 222*a* toward and closer to the release mechanism. When the dart's key 227 is engaged in sleeve 222*a*, it is also initially spaced from the ramped surface of the release mechanism. However, when dart 224 moves sleeve 222*a* to expose and thereby open port 217, key 227 is driven against the ramped surface 240. The ramped surface causes key 227 to retract and become disengaged from the sleeve, after which the dart is capable of proceeding down hole. Depending on the construction, the port sub may include alternate or additional features such as a recess in the inner diameter, such as opening 252 on sleeve 222*a* to permit movement of the key to retract. For example, opening 252 allows key 227 to kick out when retracting out of engagement with the point of engagement, groove 226*a*, with the sleeve.

Key 227 can have a chamfered leading end 227*a* to facilitate retraction when it is driven against ramped surface 240. The key can also have mechanisms that allow it to retract such as a pivotal connection 227*b* to the dart body and a biasing mechanism such as a spring 227*c* that normally biases the key out, but can allow it to retract.

While in all most other ways, port sub 216*b* is similar to port sub 216*a*, the absence of the release mechanism, ensures that dart 224 will remain engaged in the port sub even after sleeve 222*b* is moved to open port 217. For example, port sub 216*b* may have an abruptly stepped, such as a squared off, shoulder 250 instead of ramped surface 240 and sleeve 222*b* may be devoid of opening 252. Thus, the dart's key 227 cannot become disengaged from sleeve 222*b* of the type B port sub 216*b*.

As will be appreciated by review of FIGS. 1A to 1D, a string may include one or more clusters of axially spaced port subs, each cluster including one or more sub of the type A 116*a* or 216*a* and each cluster also including a lowermost sub of the type B 116*b* or 216*b*, selected based on whatever type of type A subs were used in the cluster so that the same dart actuates them all. For simplicity, it is likely that if there are a plurality of clusters along the string, the subs used will all employ the same type of dart, but of course that can vary.

A dart may be employed as follows:

1. The dart will be run in with the keys collapsible;
2. Run the dart in on wire line to depth above depth of target group of sleeves to be actuated. Depth can be determined by tracking wireline length run in and may include counting sleeves, if that is possible;

3. Activate the dart through wire line and disconnect the wire line from the dart
4. Pull wire line out of the hole, if possible;
5. When activated, the keys of the dart became expanded to engage and shift open a sleeve in which they engage;
6. Pump the dart onto the first sleeve in the target group of sleeves;
7. The dart will actuate A-type sleeves and pass through them;
8. The dart will then land into B-type sleeve to create the seal necessary to isolate the stage and become retained by the B-type sleeve;
9. Pump frac as per program, while the dart seals against fluid passage downwardly therepast; and
10. Remove the dart from its sealing position, for example, open a bypass, collapse the keys to allow the dart to flow out of the well or to be pushed to the toe, allow time for the dart to break down.

As such, the dart may be launched in an inactive condition and only be activated to an active condition when in a selected position in a tubing string. Thus the dart may include a controller 160, 260 that allows the dart to be activated to the active condition when desired. The controller may include an electrical or mechanical mechanism that allows it to be configured between the inactive and active conditions. The controller may for example, include an electrical circuit that controls activation of the keys to be moved between an inactive position, where they are not capable of engaging the closure on the target tool and an active position, where the keys are biased out and capable of engaging the closure of a target tool.

In one embodiment, the dart may have the capability of returning to an inactive condition after a particular time or when desired, such as after all the target tools of interest have been actuated. In such an embodiment, the dart may include a power supply as a component of the controller that allows the dart to later reconfigure into the inactive condition, for example, where the keys retract or become capable of retracting to allow the dart to pull out of the groove. In such an embodiment, the dart may include a function such as a receiver for receiving a signal or a timer for initiating the return to the inactive condition.

In another embodiment, the dart keys at least after activation may always have the ability to retract, but they simply do not do so in the type B subs because there is nothing to drive them to retract. This ability to retract can allow the dart to always move upwardly through the string. Thus, the dart can be moved by produced fluid pressure from below or can be pulled on the wireline. In such an embodiment, one dart may remain attached to wireline and after being activated, may be capable of actuating a first one or more subs and then moved up to actuate a further one or more subs uphole of the first subs.

Ports 117, 217 may have changeable jets to allow various sized nozzles to be installed so that flow can be controlled (limited entry) through the ports. Ports 117, 217 of the type A subs may alternately or additionally include removeable plugs to ensure there is sufficient pressure to keep the dart moving.

These port subs 116*a*, 116*b*, 216*a*, 216*b* can accommodate both open hole and cemented-in applications.

The tool surface against which seals 125, 225 land may be polished bore or seal bore against which the dart can better seal.

Seals 125, 225 could be removable from the dart and interchangeable so that one dart body can be employed with various string ID's. Thus, threads 148 may be provided onto which an appropriate sized seal stack, selected with respect to the tubing string ID, can be threaded onto the dart body.

With respect to the tubing string, connections between tubulars and subs forming the string should be sized smaller than a groove that catches keys 127, 227. Premium connections can be employed, for example. The sleeve grooves and keys may have an axial length L greater than 3 inches, for example about 4 inches, so that they are not capable of engaging in casing connections.

If the string is to be used for production, after the dart, lands and seals in a seat to actuate its target tools, the dart may be configured to allow bypass of a fluids therepast. The dart may form a bypass therethrough in any of various ways. For example, a bypass port may be opened or all or a part of the dart may dissolve. In one embodiment, at least a portion of the dart is formed of material capable of breaking down, such as dissolving, at wellbore conditions. For example, the dart materials may break down in hydrocarbons, at temperatures over 90° or over 300° F., after prolonged (>3 hours) contact with water, etc. In this embodiment, for example, after some time when the hydrocarbons start to be produced, a major portion of the dart has dissolved leaving only components such as the power source and wires which can be produced to surface with the backflowing produced fluids.

It is to be understood that in some embodiments, it may be useful to run the dart in to actuate only one tool, likely a type B tool, to selectively open a port of only that tool. The dart is activated after it has been moved down past other tools in which it could engage. The wireline may be moved or remain attached.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A wellbore assembly for selectively opening a port of a wellbore tubing string, the wellbore assembly comprising:
- a target tool in the wellbore tubing string, the target tool including a tubular body with an inner diameter, the port extending through a wall of the tubular body,
- a sleeve valve moveable to open the port;
- an actuation dart for actuating the target tool, the actuation dart comprising:
  - a body conveyable through the wellbore tubing string to reach the target tool,
  - an engagement mechanism on the body including a key capable of engaging the sleeve on the target tool, a controller for activating the engagement mechanism in response to a signal from surface; and a dart release mechanism on the target tool to drive the key of the engagement mechanism out of engagement with the sleeve valve, after the sleeve valve has moved to open the port, wherein driving the key out of engagement includes retracting the key by contact with the dart release mechanism.

2. The wellbore assembly of claim 1 wherein the wellbore string includes a plurality of target tools axially spaced apart along the wellbore tubing string downhole of the target tool and the plurality of target tools are similar to the target tool.

3. The wellbore assembly of claim 1 further comprising a final target tool axially spaced down from the target tool, the final target tool being configured to retain the actuation dart against further movement down the wellbore tubing string.

4. The wellbore assembly of claim 3 wherein the final target tool is similar to the target tool but has no dart release mechanism.

5. The wellbore assembly of claim 1 wherein the controller for the actuation dart activates the dart at a selected depth in the well.

6. The wellbore assembly of claim 1 wherein the controller is responsive to a signal from surface for activation to be capable of engaging the target tool.

7. The wellbore assembly of claim 1 further comprising a releasable wire line connector on the actuation dart.

8. The wellbore assembly of claim 7 wherein the controller is responsive to a signal conveyed from surface through a wire line for activation to be capable of engaging the target tool.

9. The wellbore assembly of claim 1 wherein the key is retractable and the dart release mechanism drives the key to retract.

10. The wellbore assembly of claim 1 wherein the controller includes a power supply and a function to inactivate the dart after activation thereof.

11. A method for actuating a target tool in a tubing string, the method comprising:

conveying an actuation dart through the tubing string in an inactive condition;

activating the actuation dart to an active condition at a position along the tubing string, the actuation dart in the active condition having a key for engaging the target tool;

moving the actuation dart to bring the key into engagement with the target tool;

pressuring up behind the actuation dart to actuate a mechanism on the target tool while the actuation dart is engaged with the target tool; and driving the key out of engagement with the target tool by actuation of the mechanism, wherein driving the key out of engagement includes retracting the key by contact with the mechanism on the target tool.

12. The method of claim 11 wherein the key is retracted during run in.

13. The method of claim 11 wherein activating occurs based on a determination of depth of the actuation dart.

14. The method of claim 11 wherein conveying includes conveying the actuation dart on a wire line.

15. The method of claim 13 wherein activating occurs based on a determination of a wire line depth.

16. The method of claim 14 wherein activating includes signaling the actuation dart through the wire line.

17. The method of claim 11 wherein actuating the target tool includes engaging and axially moving a sliding sleeve valve with the key and driving the key out of engagement includes moving the key with the sliding sleeve valve against the release mechanism adjacent the sliding sleeve valve, the release mechanism driving the key to retract.

18. The method of claim 11 further comprising moving the actuation dart down through the tubing string to a second target tool and pressuring up behind the actuation dart to actuate a second mechanism on the second target tool while the actuation dart is engaged in the second target tool; and retaining the key in engagement with the second target tool to divert fluids to the target tool and the second target tool.

* * * * *